US009132951B2

(12) United States Patent
Parsons

(10) Patent No.: US 9,132,951 B2
(45) Date of Patent: Sep. 15, 2015

(54) FOOD TRAY

(75) Inventor: Steven M. Parsons, Edmonton (CA)

(73) Assignee: ConAgra Foods RDM, Inc., Omaha ( * ) Notice: Subject to any disclaimer, the term of this patent is extended or adjusted under 35 U.S.C. 154(b) by 846 days.

(21) Appl. No.: 11/286,008

(22) Filed: Nov. 23, 2005

(65) Prior Publication Data

US 2007/0116806 A1 May 24, 2007

(51) Int. Cl.

| | |
|---|---|
| ***B29D 22/00*** | (2006.01) |
| ***C12M 1/00*** | (2006.01) |
| ***C12M 1/02*** | (2006.01) |
| ***B65D 81/34*** | (2006.01) |
| ***B65D 77/04*** | (2006.01) |
| *B65D 81/32* | (2006.01) |

(52) U.S. Cl.

CPC ..... *B65D 81/3453* (2013.01); *B65D 77/046* (2013.01); *B65D 81/3216* (2013.01); *B65D 2581/3404* (2013.01); *B65D 2581/3422* (2013.01); *B65D 2581/3425* (2013.01); *B65D 2581/3433* (2013.01)

(58) Field of Classification Search

USPC ..... 99/332; 220/574; 206/549; 426/107, 426/119

See application file for complete search history.

(56) References Cited

U.S. PATENT DOCUMENTS

| | | | | |
|---|---|---|---|---|
| 113,893 | A | 4/1871 | Joyce et al. | 220/762 |
| 166,102 | A | 7/1875 | Hennaman | 220/525 |
| 177,593 | A | 5/1876 | Van Skelline | |
| 181,823 | A | 9/1876 | Cornwall | 99/425 |
| 241,254 | A | 5/1881 | Udell | |
| 254,770 | A | 3/1882 | Hurd | 99/450 |
| 472,002 | A | 3/1892 | Ross | |
| 541,397 | A | 6/1895 | Swartout | 220/573.5 |
| 590,212 | A | 9/1897 | Daesch | 99/416 |
| 637,838 | A | 11/1899 | Vernon | |

(Continued)

FOREIGN PATENT DOCUMENTS

| | | |
|---|---|---|
| CH | 672 585 | 12/1989 |
| DE | 28 10 175 A1 | 9/1979 |

(Continued)

OTHER PUBLICATIONS

"Cafe Steamers," HealthyChoice.com, <http://www.healthychoice.com/products/meals/cafe_steamers.jsp> [retrieved Aug. 2007].

(Continued)

*Primary Examiner* — Ellen S Wood
*Assistant Examiner* — Anthony J Frost
(74) *Attorney, Agent, or Firm* — Ryan T. Grace; Advent, LLP

(57) ABSTRACT

A food tray has a lower tray containing a first food product and an upper tray nested stably at least partly inside the lower tray, with the upper tray containing a second food product. An air permeable interface is provided between the upper tray and lower tray to allow venting of steam from the lower tray during cooking. A cover is provided for the food tray. Each of the lower tray and the upper tray are formed of a material that is suitable for use in a microwave or conventional oven. Various constructions may be used to create the air permeable interface, such as lugs, ledges and lips. The upper tray may sit above the lower tray. The trays are nested loosely for ease of removal of the upper tray from the lower tray. Various configurations of cover may be used such as a sleeve, carton or lid. The upper tray may contain the higher value food product.

14 Claims, 3 Drawing Sheets

(56) References Cited

U.S. PATENT DOCUMENTS

| | | | | |
|---|---|---|---|---|
| 851,983 | A | 4/1907 | Entringer | 210/314 |
| 899,244 | A | 9/1908 | Chase | 99/412 |
| 902,181 | A | 10/1908 | Tidow | 99/408 |
| 948,198 | A | 2/1910 | Wiegand | 99/417 |
| 952,572 | A | 3/1910 | Meyer | 99/413 |
| 955,033 | A | 4/1910 | Wing | 99/428 |
| 1,004,423 | A | 9/1911 | Hanlon | 220/759 |
| 1,099,603 | A | 6/1914 | Ingersoll | |
| 1,263,004 | A | 4/1918 | Tollagsen | 126/369 |
| 1,341,960 | A | 6/1920 | Meyer et al. | 220/592.23 |
| 1,347,428 | A | 7/1920 | Wittekind | 220/573.4 |
| 1,476,910 | A | 12/1923 | Naugle | |
| 1,519,510 | A | 12/1924 | Santarsiero | 99/416 |
| 1,630,787 | A | 5/1927 | Cullen | 99/416 |
| 1,765,862 | A | 6/1930 | Clapp | |
| 1,864,081 | A | 6/1932 | Marr | |
| 1,906,592 | A | 5/1933 | Hiester | |
| 1,944,089 | A | 1/1934 | Litchfield | 150/9 |
| 1,985,978 | A | 5/1934 | Thomas | 426/113 |
| 2,021,465 | A | 11/1935 | Ritscher | 99/403 |
| 2,039,374 | A | 5/1936 | Young | |
| 2,041,227 | A | 5/1936 | Chalmers | 229/87 |
| 2,107,480 | A | 1/1938 | Holton | 126/377.1 |
| 2,149,872 | A | 3/1939 | Schmidt | 229/58 |
| 2,200,977 | A | 5/1940 | Baxter | 426/95 |
| 2,271,921 | A | 2/1942 | Luker | |
| 2,290,396 | A | 7/1942 | Webster | |
| 2,540,036 | A | 1/1951 | Spencer | |
| 2,556,115 | A | 6/1951 | Smith | 99/417 |
| 2,559,101 | A | 7/1951 | Wool | |
| 2,576,862 | A | 11/1951 | Smith et al. | |
| 2,591,578 | A | 4/1952 | McNealy et al. | |
| 2,600,566 | A | 6/1952 | Moffett | |
| 2,650,485 | A | 9/1953 | La Greca | 220/23.83 |
| 2,660,529 | A | 11/1953 | Bloom | |
| 2,667,422 | A | 1/1954 | Kauffman | |
| 2,673,805 | A | 3/1954 | Colman | 99/171 |
| 2,673,806 | A | 3/1954 | Colman | 99/171 |
| 2,714,070 | A | 7/1955 | Welch | |
| 2,741,559 | A | 4/1956 | Banowitz | 99/171 |
| 2,777,769 | A | 1/1957 | Hodges | 426/113 |
| 2,801,930 | A | 8/1957 | Paulucci | 99/193 |
| 2,805,392 | A | 9/1957 | Schnoll | 324/706 |
| 2,852,898 | A | 9/1958 | Berg | 53/182 |
| 2,858,970 | A | 11/1958 | Barnes et al. | 229/55 |
| 2,865,768 | A | 12/1958 | Barnes et al. | 99/171 |
| D185,399 | S | 6/1959 | Tupper | |
| 2,960,218 | A | 11/1960 | Cheeley | |
| 2,961,520 | A | 11/1960 | Long | |
| 2,965,501 | A | 12/1960 | Harriss | 426/120 |
| 3,012,895 | A | 12/1961 | Stelnicki | |
| 3,027,261 | A | 3/1962 | Samara | 99/171 |
| 3,035,754 | A | 5/1962 | Meister | 229/53 |
| 3,052,554 | A | 9/1962 | Colman | 99/171 |
| 3,068,779 | A | 12/1962 | Eidlisz | 99/416 |
| 3,070,275 | A | 12/1962 | Bostrom | 229/4.5 |
| 3,107,989 | A | 10/1963 | Fesco | 55/381 |
| 3,109,359 | A | 11/1963 | Falla | 99/339 |
| 3,141,400 | A | 7/1964 | Powers | |
| 3,179,036 | A | 4/1965 | Luker | |
| 3,191,520 | A | 6/1965 | Halter | |
| 3,219,460 | A | 11/1965 | Brown | |
| 3,220,635 | A | 11/1965 | Kasting et al. | 229/57 |
| 3,220,856 | A | 11/1965 | Vischer | |
| 3,240,610 | A | 3/1966 | Cease | |
| 3,244,537 | A | 4/1966 | Cease | |
| 3,246,446 | A | 4/1966 | Powers | |
| 3,262,668 | A | 7/1966 | Luker | |
| 3,271,169 | A | 9/1966 | Baker et al. | |
| 3,286,832 | A | 11/1966 | Pilger | 206/56 |
| 3,287,140 | A | 11/1966 | Brussell | |
| 3,293,048 | A | 12/1966 | Kitterman | 99/171 |
| 3,326,097 | A | 6/1967 | Lokey | 93/82 |
| 3,326,363 | A | 6/1967 | Robert et al. | |
| 3,349,941 | A | 10/1967 | Wanderer | 220/23.88 |
| 3,353,327 | A | 11/1967 | Cutler et al. | 53/28 |
| 3,353,707 | A | 11/1967 | Eyles | 206/519 |
| 3,357,152 | A | 12/1967 | Geigel | 53/29 |
| 3,396,868 | A | 8/1968 | Fitzgerald | 206/508 |
| 3,420,397 | A | 1/1969 | Miller | 220/203.09 |
| 3,421,654 | A | 1/1969 | Hexel | |
| 3,424,342 | A | 1/1969 | Scopp et al. | 220/793 |
| 3,441,418 | A | 4/1969 | Yozo | |
| 3,445,050 | A | 5/1969 | Peters et al. | |
| 3,447,714 | A | 6/1969 | Elliot | 206/1.5 |
| 3,489,075 | A | 1/1970 | O'Reilly | 99/450 |
| 3,502,483 | A | 3/1970 | Robert et al. | |
| 3,521,788 | A | 7/1970 | Carter et al. | |
| 3,547,661 | A | 12/1970 | Stevenson | |
| 3,573,430 | A | 4/1971 | Eisler | |
| 3,608,770 | A | 9/1971 | Naimoli | 220/16 |
| 3,610,135 | A | 10/1971 | Sheridan | |
| 3,610,458 | A | 10/1971 | Nissley | |
| 3,615,646 | A | 10/1971 | Neely et al. | |
| 3,620,834 | A | 11/1971 | Duffy | 117/213 |
| 3,637,132 | A | 1/1972 | Gray | 229/53 |
| 3,638,784 | A | 2/1972 | Bodolay et al. | 206/45.34 |
| 3,641,926 | A | 2/1972 | Williams et al. | 99/448 |
| 3,647,508 | A | 3/1972 | Gorrell | 117/38 |
| 3,669,688 | A | 6/1972 | Thompson | 99/139 |
| 3,718,480 | A | 2/1973 | Tremblay et al. | |
| 3,741,427 | A | 6/1973 | Doyle | 220/573.4 |
| 3,777,447 | A | 12/1973 | Herbine et al. | 53/36 |
| 3,811,374 | A | 5/1974 | Mann | |
| 3,835,280 | A | 9/1974 | Gades et al. | 219/10.55 |
| 3,836,042 | A | 9/1974 | Petitto | |
| 3,844,409 | A | 10/1974 | Bodolay et al. | 206/45.34 |
| 3,851,574 | A | 12/1974 | Katz et al. | 426/107 |
| 3,865,301 | A | 2/1975 | Pothier et al. | |
| 3,873,735 | A | 3/1975 | Chalin et al. | 426/87 |
| 3,881,027 | A | 4/1975 | Levinson | |
| 3,884,213 | A | 5/1975 | Smith | |
| 3,884,383 | A | 5/1975 | Burch et al. | |
| 3,893,567 | A | 7/1975 | Davis et al. | 206/520 |
| 3,908,029 | A | 9/1975 | Fredrickson | |
| 3,938,730 | A | 2/1976 | Detzel et al. | 229/120.01 |
| 3,941,967 | A | 3/1976 | Sumi et al. | |
| 3,956,866 | A | 5/1976 | Lattur | 53/29 |
| 3,965,323 | A | 6/1976 | Forker, Jr. et al. | |
| 3,970,241 | A | 7/1976 | Hanson | 229/58 |
| 3,973,045 | A | 8/1976 | Brandberg et al. | 426/110 |
| 3,974,353 | A | 8/1976 | Goltsos | |
| 3,975,552 | A | 8/1976 | Stangroom | |
| 3,983,256 | A | 9/1976 | Norris et al. | |
| 3,985,990 | A * | 10/1976 | Levinson | 219/729 |
| 4,018,355 | A | 4/1977 | Ando | |
| 4,031,261 | A | 6/1977 | Durst | |
| 4,036,423 | A | 7/1977 | Gordon | 229/43 |
| 4,038,425 | A | 7/1977 | Brandberg et al. | 426/107 |
| 4,043,098 | A | 8/1977 | Putnam, Jr. et al. | 53/180 M |
| 4,065,583 | A | 12/1977 | Ahlgren | |
| 4,077,853 | A | 3/1978 | Coll-Palagos | 204/20 |
| 4,079,853 | A | 3/1978 | Casutt | |
| 4,082,184 | A | 4/1978 | Hammer | 206/519 |
| 4,082,691 | A | 4/1978 | Berger | |
| 4,096,948 | A | 6/1978 | Kuchenbecker | |
| 4,113,095 | A | 9/1978 | Dietz et al. | |
| 4,118,913 | A | 10/1978 | Putnam, Jr. et al. | 53/551 |
| 4,126,945 | A | 11/1978 | Manser et al. | |
| 4,132,811 | A | 1/1979 | Standing et al. | 426/111 |
| 4,133,896 | A | 1/1979 | Standing et al. | |
| 4,136,505 | A | 1/1979 | Putnam, Jr. et al. | 53/551 |
| 4,137,333 | A | 1/1979 | Daswick | |
| 4,138,054 | A | 2/1979 | Spencer | |
| 4,140,889 | A | 2/1979 | Mason et al. | 219/733 |
| 4,154,860 | A | 5/1979 | Daswick | |
| 4,156,806 | A | 5/1979 | Teich et al. | 219/10.55 E |
| 4,164,174 | A | 8/1979 | Wallsten | 99/415 |
| 4,171,605 | A | 10/1979 | Putnam, Jr. et al. | 53/552 |
| 4,184,061 | A | 1/1980 | Suzuki et al. | 219/10.55 E |
| 4,186,217 | A | 1/1980 | Tchack | |
| 4,190,757 | A | 2/1980 | Turpin et al. | 219/10.55 E |
| 4,196,331 | A | 4/1980 | Leveckis et al. | 219/10.55 E |
| D255,751 | S | 7/1980 | Daenen | D7/667 |

(56) References Cited

U.S. PATENT DOCUMENTS 4,219,573 A 8/1980 Borek ..... 426/107
4,228,945 A 10/1980 Wysocki
4,230,767 A 10/1980 Isaka et al. ..... 428/349
4,230,924 A 10/1980 Brastad et al. ..... 219/10.55 E
4,233,325 A 11/1980 Slangan et al.
4,241,563 A 12/1980 Müller et al. ..... 53/511
4,242,378 A 12/1980 Arai ..... 427/264
4,258,086 A 3/1981 Beall ..... 219/10.43
4,264,668 A 4/1981 Balla ..... 428/195
4,267,420 A 5/1981 Brastad ..... 219/10.55 E
4,279,933 A 7/1981 Austin et al. ..... 426/124
4,280,032 A 7/1981 Levison
4,283,427 A 8/1981 Winters et al. ..... 426/107
4,291,520 A 9/1981 Prince et al. ..... 53/551
4,292,332 A 9/1981 McHam ..... 426/111
4,304,352 A 12/1981 Humphries
4,306,133 A 12/1981 Levinson
4,314,650 A 2/1982 Cillario
4,316,070 A 2/1982 Prosise et al. ..... 219/10.55 E
4,317,017 A 2/1982 Bowen
4,324,088 A 4/1982 Yamashita et al. ..... 53/527
4,328,254 A 5/1982 Waldburger
4,335,291 A 6/1982 Ishino et al. ..... 219/10.55 E
4,340,138 A 7/1982 Bernhardt ..... 206/216
4,345,133 A 8/1982 Cherney et al. ..... 219/10.55 E
4,348,421 A 9/1982 Sakakibara et al.
4,351,997 A 9/1982 Mattisson et al.
4,355,757 A 10/1982 Roccaforte ..... 229/33
4,373,511 A 2/1983 Miles et al. ..... 126/369
4,377,493 A 3/1983 Boylan et al.
4,389,438 A 6/1983 Ohtsuki et al. ..... 428/35
4,390,555 A 6/1983 Levinson
4,398,994 A 8/1983 Beckett ..... 156/659.1
4,416,906 A 11/1983 Watkins
4,425,368 A 1/1984 Watkins
4,439,656 A 3/1984 Peleg
4,453,665 A 6/1984 Roccaforte et al. ..... 229/41 B
4,461,031 A 7/1984 Blamer ..... 383/123
4,477,705 A 10/1984 Danley et al.
4,478,349 A 10/1984 Haverland et al. ..... 220/573.4
4,481,392 A 11/1984 Nibbe et al.
4,486,640 A * 12/1984 Bowen et al. ..... 219/729
4,493,685 A 1/1985 Blamer ..... 493/235
4,496,815 A 1/1985 Jorgensen
4,517,045 A 5/1985 Beckett ..... 156/345
4,518,651 A 5/1985 Wolfe, Jr. ..... 428/308.8
4,529,089 A 7/1985 Gasbarra et al. ..... 206/525
4,532,397 A 7/1985 McClelland
D280,058 S 8/1985 Carlson ..... D7/629
4,535,889 A 8/1985 Terauds ..... 206/527
4,552,614 A 11/1985 Beckett ..... 156/640
4,553,010 A 11/1985 Bohrer et al. ..... 219/10.55 E
4,571,337 A 2/1986 Cage et al. ..... 426/107
4,574,776 A 3/1986 Hidle
4,581,989 A 4/1986 Swartley ..... 99/346
4,584,202 A 4/1986 Roccaforte ..... 426/111
4,586,649 A 5/1986 Webinger ..... 229/114
4,610,755 A 9/1986 Beckett ..... 156/634
4,612,431 A 9/1986 Brown et al. ..... 219/10.55 E
4,626,352 A 12/1986 Massey et al. ..... 210/469
4,634,003 A 1/1987 Ueda et al.
4,640,838 A 2/1987 Isakson et al. ..... 426/107
4,641,005 A 2/1987 Seiferth ..... 219/10.55 E
4,648,549 A 3/1987 Trutna
4,657,141 A 4/1987 Sorensen ..... 206/519
4,661,326 A 4/1987 Schainholz ..... 422/310
4,661,671 A 4/1987 Maroszek ..... 219/10.55 E
4,661,672 A 4/1987 Nakanaga
4,676,857 A 6/1987 Scharr et al. ..... 156/233
4,677,905 A 7/1987 Johnson ..... 99/413
4,678,882 A 7/1987 Bohrer et al. ..... 219/10.55 E
D291,522 S 8/1987 Daenen et al. ..... D7/667
4,685,997 A 8/1987 Beckett ..... 156/629
4,697,703 A 10/1987 Will ..... 206/438
4,701,585 A 10/1987 Stewart ..... 219/10.55 E
4,703,148 A 10/1987 Mikulski et al.
4,703,149 A 10/1987 Sugisawa et al.
4,705,927 A 11/1987 Levendusky et al. .. 219/10.55 E
4,713,510 A 12/1987 Quick et al. ..... 219/10.55 E
4,714,012 A 12/1987 Hernandez ..... 99/444
4,727,706 A 3/1988 Beer ..... 53/434
4,734,288 A 3/1988 Engstrom et al. ..... 426/107
4,738,882 A 4/1988 Rayford et al. ..... 428/35
4,739,698 A 4/1988 Allaire ..... 99/410
4,739,898 A 4/1988 Brown ..... 220/203.21
4,745,249 A 5/1988 Daniels
4,777,053 A 10/1988 Tobelmann et al.
4,794,005 A 12/1988 Swiontek
4,797,010 A 1/1989 Coelho ..... 383/109
4,803,088 A 2/1989 Yamamoto et al.
4,804,582 A 2/1989 Noding et al. ..... 428/332
4,806,718 A 2/1989 Seaborne et al. ..... 219/10.55 E
4,808,780 A 2/1989 Seaborne ..... 219/10.55 E
4,810,845 A 3/1989 Seaborne ..... 219/10.55 E
4,818,831 A 4/1989 Seaborne ..... 219/10.55 E
4,825,025 A 4/1989 Seiferth ..... 219/10.55 E
4,842,876 A 6/1989 Anderson et al.
4,846,350 A 7/1989 Sorensen ..... 206/520
4,848,579 A 7/1989 Barnes et al.
4,851,246 A 7/1989 Maxwell et al. ..... 426/107
4,853,505 A 8/1989 Sorenson
4,853,509 A 8/1989 Murakami
4,864,089 A 9/1989 Tighe et al. ..... 219/10.55 E
4,864,090 A 9/1989 Maxwell et al. ..... 219/10.55 E
4,870,233 A 9/1989 McDonald et al.
4,873,919 A 10/1989 Janssen
4,883,936 A 11/1989 Maynard et al. ..... 219/10.55 E
4,892,744 A 1/1990 Ylvisaker ..... 426/111
4,896,009 A 1/1990 Pawlowski ..... 219/10.55 E
4,899,925 A 2/1990 Bowden et al.
4,904,488 A 2/1990 LaBaw et al. ..... 426/107
4,914,266 A 4/1990 Parks et al. ..... 219/10.55 E
4,915,216 A 4/1990 Magers ..... 206/520
4,915,780 A 4/1990 Beckett ..... 156/661.1
4,920,251 A 4/1990 Whitenack et al.
4,922,079 A 5/1990 Bowen et al.
4,923,704 A 5/1990 Levinson
4,924,048 A 5/1990 Bunce et al.
4,935,592 A 6/1990 Oppenheimer
4,939,332 A 7/1990 Hahn
4,943,456 A 7/1990 Pollart et al. ..... 428/34.3
4,948,932 A 8/1990 Clough ..... 219/10.55 E
4,952,765 A 8/1990 Toyosawa
4,959,516 A 9/1990 Tighe et al. ..... 219/10.55 E
4,960,598 A 10/1990 Swiontek
4,961,944 A 10/1990 Matoba et al.
4,963,708 A 10/1990 Kearns et al.
D312,189 S 11/1990 Noel
4,973,502 A 11/1990 Holzmuller et al. ..... 428/35.8
4,973,810 A 11/1990 Brauner ..... 219/10.55 E
4,982,064 A 1/1991 Hartman et al. ..... 219/10.55 E
4,987,280 A 1/1991 Kanafani et al.
4,990,349 A 2/1991 Chawan et al.
4,992,638 A 2/1991 Hewitt et al.
5,011,299 A 4/1991 Black, Jr. et al. ..... 383/126
5,025,715 A 6/1991 Sir
5,026,958 A 6/1991 Palacios
5,035,800 A 7/1991 Kopach ..... 210/469
5,038,009 A 8/1991 Babbitt ..... 219/10.55 E
5,039,001 A 8/1991 Kinigakis et al. ..... 229/120
5,041,295 A 8/1991 Perry et al.
5,044,777 A 9/1991 Watkins et al. ..... 383/100
5,050,791 A 9/1991 Bowden et al.
5,052,369 A 10/1991 Johnson
5,057,331 A * 10/1991 Levinson ..... 426/243
D321,302 S 11/1991 Zimmerman
5,063,072 A 11/1991 Gillmore et al.
5,075,526 A 12/1991 Sklenak et al.
5,077,066 A 12/1991 Mattson et al.
5,081,330 A 1/1992 Brandberg et al. .... 219/10.55 E
5,094,865 A 3/1992 Levinson
5,095,186 A 3/1992 Scott Russell et al. 219/10.55 E
5,106,635 A 4/1992 McCutchan et al.
5,107,087 A 4/1992 Yamada et al.

(56) References Cited

U.S. PATENT DOCUMENTS

| | | | | |
|---|---|---|---|---|
| 5,108,768 | A | 4/1992 | So | |
| 5,153,402 | A | 10/1992 | Quick et al. | 219/10.55 E |
| 5,176,284 | A * | 1/1993 | Sorensen | 220/659 |
| 5,189,947 | A | 3/1993 | Yim | 426/109 |
| 5,190,777 | A | 3/1993 | Anderson et al. | |
| 5,195,829 | A | 3/1993 | Watkins et al. | 383/100 |
| 5,200,590 | A | 4/1993 | Bowen et al. | 219/10.55 E |
| D335,445 | S | 5/1993 | Detert et al. | D9/761 |
| D335,821 | S | 5/1993 | Detert et al. | D9/761 |
| D336,242 | S | 6/1993 | Detert et al. | D9/761 |
| 5,223,291 | A | 6/1993 | Levinson et al. | |
| 5,230,914 | A | 7/1993 | Akervik | |
| 5,241,149 | A | 8/1993 | Watanabe et al. | |
| D341,990 | S | 12/1993 | Yim | |
| 5,294,765 | A | 3/1994 | Archibald et al. | 219/727 |
| 5,298,708 | A | 3/1994 | Babu et al. | 219/728 |
| 5,300,747 | A | 4/1994 | Simon | |
| 5,315,083 | A | 5/1994 | Green | |
| 5,342,634 | A | 8/1994 | Murata et al. | |
| 5,363,750 | A | 11/1994 | Miller et al. | 99/426 |
| D353,303 | S | 12/1994 | Davis | |
| 5,370,042 | A | 12/1994 | Tolchin et al. | |
| 5,419,451 | A * | 5/1995 | Bitel, Jr. | 220/575 |
| 5,423,453 | A | 6/1995 | Fritz | |
| 5,520,301 | A | 5/1996 | Sohn | 220/265 |
| D370,598 | S | 6/1996 | Koch | |
| D371,963 | S | 7/1996 | Ahern, Jr. | |
| 5,540,381 | A | 7/1996 | Davis | 229/103.2 |
| 5,558,798 | A | 9/1996 | Tsai | |
| D376,512 | S | 12/1996 | Klemme | D7/538 |
| 5,588,587 | A | 12/1996 | Stier et al. | |
| D378,565 | S | 3/1997 | Cousins | D7/667 |
| D378,566 | S | 3/1997 | Cousins | D7/667 |
| 5,632,403 | A | 5/1997 | Deng | |
| 5,645,300 | A | 7/1997 | Hill | |
| 5,645,762 | A | 7/1997 | Cook et al. | |
| 5,650,084 | A | 7/1997 | Bley | 219/727 |
| 5,662,026 | A | 9/1997 | Prakasa | |
| D384,555 | S | 10/1997 | Bradley | |
| 5,674,546 | A | 10/1997 | Barnes et al. | |
| D386,042 | S | 11/1997 | Miller | |
| 5,690,853 | A | 11/1997 | Jackson et al. | 219/727 |
| 5,695,801 | A | 12/1997 | Oh | |
| 5,698,306 | A | 12/1997 | Prosise et al. | |
| 5,704,485 | A | 1/1998 | Cautereels et al. | 206/546 |
| 5,718,933 | A | 2/1998 | Fultz | 426/115 |
| D391,440 | S | 3/1998 | Cousins | D7/360 |
| 5,726,426 | A | 3/1998 | Davis et al. | |
| 5,741,534 | A | 4/1998 | Chung | |
| 5,747,086 | A | 5/1998 | Bows et al. | |
| 5,753,895 | A | 5/1998 | Olson et al. | 219/727 |
| 5,770,840 | A | 6/1998 | Lorence | |
| 5,807,597 | A | 9/1998 | Barnes et al. | |
| 5,826,494 | A | 10/1998 | Wang | |
| D405,561 | S | 2/1999 | Willinger et al. | D30/129 |
| 5,866,041 | A | 2/1999 | Svarz et al. | |
| 5,869,120 | A | 2/1999 | Blazevich | 426/132 |
| 5,871,790 | A | 2/1999 | Monier et al. | 426/107 |
| 5,876,811 | A | 3/1999 | Blackwell et al. | |
| 5,900,264 | A | 5/1999 | Gics | |
| 5,913,966 | A | 6/1999 | Arnone et al. | 99/413 |
| 5,916,470 | A | 6/1999 | Besser et al. | |
| 5,916,620 | A | 6/1999 | Oh | |
| 5,925,281 | A | 7/1999 | Levinson | |
| 5,928,554 | A | 7/1999 | Olson et al. | 219/727 |
| 5,931,333 | A | 8/1999 | Woodnorth et al. | 220/573.4 |
| 5,961,872 | A | 10/1999 | Simon et al. | |
| 5,970,858 | A | 10/1999 | Boehm et al. | 99/446 |
| 5,974,953 | A | 11/1999 | Messerli | 99/340 |
| 5,986,248 | A | 11/1999 | Matsuno et al. | 219/728 |
| 5,988,045 | A | 11/1999 | Housley | |
| 5,988,050 | A | 11/1999 | Foster, Jr. | 99/467 |
| D418,017 | S | 12/1999 | Henry | |
| D419,371 | S | 1/2000 | Haley | D7/392.1 |
| 6,018,157 | A | 1/2000 | Craft | |
| 6,042,856 | A | 3/2000 | Sagan et al. | 426/87 |
| D422,176 | S | 4/2000 | Laib | |
| 6,049,072 | A | 4/2000 | Olson et al. | 219/727 |
| 6,085,930 | A * | 7/2000 | Curtis | 220/371 |
| 6,097,017 | A | 8/2000 | Pickford | |
| 6,103,291 | A | 8/2000 | Fernandez Tapia | 426/523 |
| 6,106,882 | A | 8/2000 | Oh et al. | |
| D432,414 | S | 10/2000 | Simpson et al. | D9/711 |
| D432,914 | S | 10/2000 | Hayes et al. | |
| 6,126,976 | A | 10/2000 | Hasse, Jr. et al. | |
| 6,136,355 | A | 10/2000 | Fukuyama | |
| D433,884 | S | 11/2000 | Fujimoto | D7/667 |
| 6,147,337 | A | 11/2000 | Besser | |
| 6,150,646 | A | 11/2000 | Lai et al. | |
| 6,168,044 | B1 * | 1/2001 | Zettle et al. | 220/784 |
| 6,175,105 | B1 | 1/2001 | Rubbright et al. | |
| 6,180,148 | B1 | 1/2001 | Yajima | |
| 6,180,150 | B1 | 1/2001 | Schäfer | |
| 6,183,789 | B1 | 2/2001 | Nilsson et al. | |
| 6,187,354 | B1 | 2/2001 | Hopkins | |
| 6,192,792 | B1 | 2/2001 | Gremillion | |
| 6,196,406 | B1 | 3/2001 | Ennis | |
| 6,217,918 | B1 | 4/2001 | Oh et al. | |
| D441,597 | S | 5/2001 | Wyche | |
| D442,425 | S | 5/2001 | Wyche | |
| 6,229,131 | B1 | 5/2001 | Koochaki | |
| 6,230,919 | B1 | 5/2001 | Guillin | |
| D445,633 | S | 7/2001 | Bradley | |
| D449,102 | S | 10/2001 | Shin | D23/366 |
| D449,495 | S | 10/2001 | Tucker et al. | |
| 6,309,684 | B2 | 10/2001 | Hopkins, Sr. | |
| 6,365,206 | B1 | 4/2002 | Yanai et al. | |
| 6,394,337 | B1 | 5/2002 | Ross et al. | 229/103.2 |
| 6,396,036 | B1 | 5/2002 | Hanson | 219/727 |
| 6,422,453 | B1 | 7/2002 | Wang | |
| 6,455,084 | B2 | 9/2002 | Johns | |
| 6,463,844 | B1 | 10/2002 | Wang et al. | |
| 6,467,399 | B1 | 10/2002 | Boutte | |
| 6,486,455 | B1 | 11/2002 | Merabet | |
| D466,762 | S | 12/2002 | Cote et al. | D7/545 |
| 6,509,047 | B2 | 1/2003 | Edomwonyi | |
| D470,768 | S | 2/2003 | Melhede | D9/428 |
| 6,546,849 | B1 | 4/2003 | Shimazaki | |
| 6,559,431 | B2 * | 5/2003 | Hopkins | 219/735 |
| 6,565,910 | B1 | 5/2003 | Schell et al. | 426/589 |
| D477,187 | S | 7/2003 | McCallister et al. | |
| 6,608,292 | B1 | 8/2003 | Barnes | |
| 6,612,482 | B2 | 9/2003 | Ross | 229/103.2 |
| 6,645,539 | B2 | 11/2003 | Bukowski et al. | |
| D483,616 | S | 12/2003 | Thonis | |
| D485,473 | S | 1/2004 | Dais et al. | D7/629 |
| 6,727,484 | B2 | 4/2004 | Policappelli | |
| 6,803,551 | B2 | 10/2004 | Kim et al. | 219/731 |
| D497,774 | S | 11/2004 | Smith et al. | D7/543 |
| 6,818,873 | B2 | 11/2004 | Savage et al. | |
| 6,840,159 | B1 | 1/2005 | Li | 99/337 |
| D502,847 | S | 3/2005 | Leonori | D7/667 |
| 6,868,980 | B2 | 3/2005 | Schultz et al. | 220/367.1 |
| D505,048 | S | 5/2005 | Cornfield | D7/409 |
| D505,590 | S | 5/2005 | Greiner et al. | D7/409 |
| D508,822 | S | 8/2005 | Smith et al. | |
| D513,942 | S | 1/2006 | De Groote | D7/665 |
| 7,008,214 | B2 | 3/2006 | Faddi | 425/382 R |
| 7,022,359 | B2 | 4/2006 | Montserrate Gibernau | |
| 7,025,213 | B2 | 4/2006 | Chen | 210/474 |
| D521,380 | S | 5/2006 | Jackson et al. | |
| 7,038,181 | B2 | 5/2006 | Edmark | |
| 7,045,190 | B2 | 5/2006 | Inagaki et al. | |
| D526,840 | S | 8/2006 | Carlson | D7/392.1 |
| 7,090,090 | B2 | 8/2006 | Ohyama | |
| D529,797 | S | 10/2006 | Wilcox et al. | D9/428 |
| D543,796 | S | 6/2007 | Lion et al. | D7/667 |
| D552,433 | S | 10/2007 | Stewart | D7/667 |
| D557,982 | S | 12/2007 | Ablo et al. | D7/409 |
| D558,536 | S | 1/2008 | Curtin | D7/667 |
| D558,602 | S | 1/2008 | Kissner et al. | D9/711 |
| D563,157 | S | 3/2008 | Bouveret et al. | |
| D564,287 | S | 3/2008 | Bouveret et al. | |
| D564,307 | S | 3/2008 | Repp | D7/667 |

(56) References Cited

U.S. PATENT DOCUMENTS

| | | | | |
|---|---|---|---|---|
| D571,656 | S | 6/2008 | Maslowski | D9/425 |
| D577,295 | S | 9/2008 | Miller et al. | D9/711 |
| D582,201 | S | 12/2008 | Kellermann | |
| D582,791 | S | 12/2008 | Elmerhaus | D9/721 |
| 7,468,498 | B2 | 12/2008 | Tuszkiewicz et al. | 219/725 |
| D584,111 | S | 1/2009 | Eide et al. | D7/667 |
| D584,145 | S | 1/2009 | Young | |
| D590,663 | S | 4/2009 | Simon et al. | |
| D591,591 | S | 5/2009 | Moecks et al. | |
| D592,948 | S | 5/2009 | Mayer | D9/418 |
| D593,369 | S | 6/2009 | Green et al. | D7/602 |
| D594,328 | S | 6/2009 | Shapiro et al. | D9/435 |
| D598,717 | S | 8/2009 | Jalet | D7/667 |
| D607,095 | S | 12/2009 | LeMay et al. | D23/366 |
| D610,903 | S | 3/2010 | Shapiro et al. | D9/428 |
| D611,300 | S | 3/2010 | Chen et al. | D7/409 |
| D612,196 | S | 3/2010 | Furlong | D7/392.1 |
| D613,131 | S | 4/2010 | Chen et al. | D7/667 |
| D630,061 | S | 1/2011 | Kellermann | |
| D630,507 | S | 1/2011 | Short et al. | D9/427 |
| D630,940 | S | 1/2011 | Shapiro et al. | D9/428 |
| D632,561 | S | 2/2011 | Short et al. | D9/427 |
| D633,810 | S | 3/2011 | Jenkins | D9/721 |
| 7,977,612 | B2 | 7/2011 | Levy et al. | 219/729 |
| 2001/0035402 | A1 | 11/2001 | Barrow | 219/432 |
| 2001/0043971 | A1 | 11/2001 | Johns | |
| 2001/0050002 | A1 | 12/2001 | Bonanno | |
| 2002/0096450 | A1 | 7/2002 | Garst | 206/516 |
| 2002/0110622 | A1 | 8/2002 | Lloyd et al. | 426/115 |
| 2003/0003200 | A1 | 1/2003 | Bukowski et al. | |
| 2003/0068411 | A1 | 4/2003 | McCallister | 426/107 |
| 2003/0167932 | A1 | 9/2003 | Chen | |
| 2003/0213718 | A1 | 11/2003 | Ducharme et al. | |
| 2004/0058038 | A1* | 3/2004 | Lee | 426/107 |
| 2004/0107637 | A1 | 6/2004 | Sieverding | 47/83 |
| 2004/0121049 | A1 | 6/2004 | Ebner et al. | |
| 2004/0164075 | A1* | 8/2004 | Henze et al. | 219/740 |
| 2004/0216620 | A1 | 11/2004 | Quiggins et al. | |
| 2004/0238438 | A1 | 12/2004 | Chen | 210/474 |
| 2005/0034611 | A1 | 2/2005 | McLemore | |
| 2005/0040161 | A1 | 2/2005 | Lin et al. | |
| 2005/0051549 | A1 | 3/2005 | Nelson | 220/23.83 |
| 2005/0069602 | A1 | 3/2005 | Faddi | 425/208 |
| 2005/0079250 | A1 | 4/2005 | Mao et al. | 426/113 |
| 2005/0079252 | A1 | 4/2005 | Kendig et al. | 426/125 |
| 2005/0082305 | A1 | 4/2005 | Dais et al. | |
| 2005/0092762 | A1 | 5/2005 | Murat et al. | |
| 2005/0109772 | A1 | 5/2005 | Thorpe et al. | |
| 2005/0112243 | A1 | 5/2005 | Bellmann | 426/106 |
| 2005/0115417 | A1 | 6/2005 | Murat et al. | 99/413 |
| 2005/0208182 | A1 | 9/2005 | Gilbert et al. | 426/87 |
| 2005/0220939 | A1 | 10/2005 | Morrow | 426/86 |
| 2005/0229793 | A1 | 10/2005 | Wengrovsky | 99/483 |
| 2005/0256060 | A1 | 11/2005 | Hilgers et al. | 514/25 |
| 2005/0271776 | A1 | 12/2005 | Siegel | 426/138 |
| 2005/0281921 | A1 | 12/2005 | Langston et al. | |
| 2006/0013929 | A1 | 1/2006 | Morris et al. | |
| 2006/0088678 | A1 | 4/2006 | Berrier et al. | |
| 2006/0110498 | A1 | 5/2006 | Dellinger et al. | |
| 2006/0118552 | A1 | 6/2006 | Tiefenback | |
| 2006/0121168 | A1 | 6/2006 | Flaherty et al. | |
| 2006/0151339 | A1 | 7/2006 | Bradley et al. | |
| 2006/0236593 | A1 | 10/2006 | Cap | |
| 2006/0260598 | A1 | 11/2006 | Bjork et al. | |
| 2006/0289522 | A1 | 12/2006 | Middleton et al. | 219/730 |
| 2007/0029314 | A1 | 2/2007 | Rodgers et al. | |
| 2007/0059406 | A1 | 3/2007 | Shahsavarani | 426/106 |
| 2007/0090103 | A1 | 4/2007 | France | |
| 2007/0092610 | A1 | 4/2007 | Mize | |
| 2007/0116807 | A1 | 5/2007 | Parsons | |
| 2007/0131679 | A1 | 6/2007 | Edwards et al. | |
| 2007/0181008 | A1 | 8/2007 | Pawlick | |
| 2007/0251874 | A1 | 11/2007 | Stewart | 210/232 |
| 2008/0069485 | A1 | 3/2008 | France et al. | |
| 2008/0138473 | A1 | 6/2008 | Pawlick et al. | |
| 2008/0178744 | A1 | 7/2008 | Hill | 99/323.5 |
| 2008/0210686 | A1 | 9/2008 | Shapiro et al. | |
| 2009/0022858 | A1 | 1/2009 | Pawlick | |
| 2009/0035433 | A1 | 2/2009 | France et al. | |
| 2009/0078125 | A1 | 3/2009 | Pawlick et al. | |
| 2009/0142455 | A1 | 6/2009 | Parsons | 426/120 |
| 2010/0015293 | A1 | 1/2010 | Shapiro | |

FOREIGN PATENT DOCUMENTS

| | | | |
|---|---|---|---|
| EP | 0326105 | A1 | 8/1989 |
| EP | 0449643 | A1 | 5/1995 |
| EP | 1 245 504 | A1 | 10/2002 |
| EP | 1 352 841 | A1 | 10/2003 |
| EP | 1 352 848 | A1 | 10/2003 |
| EP | 1 514 804 | A1 | 3/2005 |
| EP | 1 464 262 | B1 | 7/2005 |
| EP | 1 612 150 | A1 | 1/2006 |
| EP | 1 749 757 | A2 | 2/2007 |
| FR | 2 631 315 | A3 | 11/1989 |
| FR | 2 774 262 | A1 | 8/1999 |
| FR | 2 846 196 | A1 | 4/2004 |
| FR | 2 860 213 | | 4/2005 |
| FR | 2 929 491 | | 10/2009 |
| GB | 1 560 488 | | 2/1980 |
| GB | 2 218 962 | A | 11/1989 |
| GB | 2 295 371 | A | 5/1996 |
| GB | 2 308 465 | A | 6/1997 |
| GB | 2 340 823 | A | 3/2000 |
| JP | 2-109882 | | 4/1990 |
| JP | 4367476 | A | 12/1992 |
| JP | 06293366 | | 10/1994 |
| JP | 09051767 | | 2/1997 |
| JP | 10094370 | A | 4/1998 |
| JP | 10-129742 | | 5/1998 |
| JP | 11113511 | | 4/1999 |
| JP | 2001348074 | A | 12/2001 |
| JP | 2005059863 | A | 3/2005 |
| JP | A-2005-312923 | | 11/2005 |
| JP | A-2006-34645 | | 2/2006 |
| JP | 2010-189031 | | 9/2010 |
| MX | 01011879 | A | 6/2002 |
| SU | 1149999 | A | 4/1985 |
| WO | WO 86/00275 | | 1/1986 |
| WO | WO 96/07604 | | 3/1996 |
| WO | WO 98/33399 | | 8/1998 |
| WO | WO 99/59897 | | 11/1999 |
| WO | WO 02/051716 | | 7/2002 |
| WO | WO 03/086882 | A1 | 10/2003 |
| WO | WO 2004/045970 | A1 | 6/2004 |
| WO | WO 2006/098950 | A2 | 9/2006 |
| WO | WO 2006/128156 | A2 | 11/2006 |
| WO | WO 2006/136825 | A1 | 12/2006 |
| WO | WO 2007/003864 | A2 | 1/2007 |
| WO | WO 2008/109448 | A2 | 9/2008 |
| WO | WO 2008/109448 | A3 | 9/2008 |
| WO | WO 2009/097030 | A1 | 8/2009 |
| WO | WO 2009/136038 | A1 | 11/2009 |

OTHER PUBLICATIONS

France, D.W., "Steam Cooking Apparatus," U.S. Appl. No. 60/728,468, filed Oct. 20, 2005.

"Ziploc® Containers With Snap'n'Seal Lids: Designed With You in Mind", brochure found at http://www.ziploc.com/food-storage-containers/ as printed on Nov. 14, 2005, 2 pgs.

"Ziploc® Containers With Snap'n'Seal Lids: Storage Made Simpler!", brochure found at http://www.ziploc.com/new_containers.html as printed on Nov. 14, 2005, 1 page.

Photographs of a food tray available from Inter Frost GmbH at a trade show in Germany, Oct. 2005.

Anchor Hocking '70 Catalog, p. 83, baking dishes at #4, 5 and 6 (Oct. 1970).

McCallister, "Microwaveable Pasta Product," U.S. Appl. No. 09/965,300, filed Sep. 28, 2001.

http://www.unclebens.de/produkte/heiss_auf_reis/heiss_auf_reis_uebersicht.aspx Undated.

(56) References Cited

OTHER PUBLICATIONS http://www.buypastanmore.com Undated.
U.S. Official Action Mailed Dec. 9, 2010 in U.S. Appl. No. 29/346,147.
U.S. Official Action Mailed Dec. 9, 2010 in U.S. Appl. No. 29/346,148.
U.S. Official Action Mailed Dec. 28, 2010 in U.S. Appl. No. 29/364,804.
U.S. Official Action Mailed Mar. 21, 2011 in U.S. Appl. No. 11/703,066.
Supp. International Search Report dated Mar. 15, 2011, Application No. PCT/CA2006/001894.
U.S. Official Action mailed Jul. 15, 2011, in U.S. Appl. No. 11/423,259.
European Search Report dated Jan. 27, 2011, in Application No. 08832921.4-1261.
U.S. Appl. No. 29/346,147, filed Oct. 27, 2009 entitled "Container Assembly".
U.S. Appl. No. 29/346,148, filed Oct. 27, 2009 entitled Container Basket.
U.S. Appl. No. 29/364,804, filed Jun. 29, 2010 entitled "Container Assembly".
U.S. Appl. No. 29/364,807, filed Jun. 29, 2010 entitled "Container Basket".
Certified priority document in U.S. Appl. No. 12/012,403, filed Feb. 2, 2008 (filed in Int'l Application No. PCT/US2008/080874 on Nov. 3, 2008).
http://www.pastanmoresale.com, site accessed Jun. 15, 2010, 2 pgs. (now being sold at http://pastaboat.com).
Machine translation FR 2774262, Etimble et al., Aug. 1999, 9 pgs.
Invitation to Pay Additional Fees with Partial International Search mailed Jun. 25, 2008.
International Search Report dated Aug. 20, 2008, Application No. PCT/US2008/055512.
International Search Report dated Oct. 20, 2008, Application No. PCT/US2008/071917.
International Search Report dated Jan. 12, 2009, Application No. PCT/US2008/077353.
U.S. Official Action Mailed Sep. 18, 2008 in U.S. Appl. No. 11/424,520.
U.S. Official Action Mailed Apr. 30, 2009 in U.S. Appl. No. 11/424,520.
U.S. Official Action Mailed Oct. 16, 2009 in U.S. Appl. No. 11/903,732.
U.S. Official Action Mailed Oct. 29, 2009 in U.S. Appl. No. 11/890,297.
U.S. Official Action Mailed Nov. 25, 2009 in U.S. Appl. No. 11/424,520.
U.S. Official Action Mailed Mar. 10, 2010 in U.S. Appl. No. 11/903,732.
U.S. Official Action Mailed Mar. 29, 2010 in U.S. Appl. No. 29/351,253.
U.S. Official Action Mailed Apr. 14, 2010 in U.S. Appl. No. 11/424,520.
U.S. Official Action Mailed Oct. 6, 2010 in U.S. Appl. No. 11/424,520.
U.S. Official Action Mailed Oct. 7, 2010 in U.S. Appl. No. 11/703,066.
U.S. Official Action Mailed Apr. 1, 2011 in U.S. Appl. No. 11/424,520.
U.S. Official Action Mailed Apr. 6, 2011 in U.S. Appl. No. 12/277,886.
U.S. Official Action Mailed Apr. 8, 2011 in U.S. Appl. No. 29/369,416.
U.S. Official Action Mailed Apr. 12, 2011 in U.S. Appl. No. 29/369,423.
U.S. Official Action Mailed Feb. 23, 2010 in U.S. Appl. No. 29/369,419.
European Office Action mailed Jul. 15, 2010 in Application No. 08731136.1.
U.S. Official Action Mailed May 25, 2010 in U.S. Appl. No. 11/423,259.
U.S. Official Action Mailed Nov. 10, 2010 in U.S. Appl. No. 11/423,259.
European Allowance dated Jul. 18, 2011, in Application No. 10163678.5-2308.
U.S. Official Action mailed Aug. 9, 2011, in U.S. Appl. No. 11/903,732.
U.S. Official Action mailed Aug. 11, 2011, in U.S. Appl. No. 11/703,066.
U.S. Official Action mailed Aug. 19, 2011, in U.S. Appl. No. 11/424,520.
U.S. Official Action mailed Aug. 25, 2011 in U.S. Appl. No. 12/277,886.
"Propylene Glycol Monostearate"; *Hawley's Condensed Chemical Dictionary Thirteenth Edition*; 1997.
U.S. Official Action mailed Jan. 24, 2013, in U.S. Appl. No. 12/471,114.
U.S. Official Action mailed Nov. 7, 2011, in U.S. Appl. No. 11/890,297.
U.S. Official Action mailed Dec. 20, 2011, in U.S. Appl. No. 11/423,259.
U.S. Official Action mailed Jan. 11, 2012, in U.S. Appl. No. 11/703,066.
U.S. Official Action mailed Jan. 25, 2012, in U.S. Appl. No. 11/903,732.
U.S. Official Action mailed Mar. 26, 2012, in U.S. Appl. No. 11/424,520.
Starmaid Microwave Steamer Jun. 26, 2006, [on line], retrieved on Oct. 13, 2011. Retrieved from the Internet: URL:<http://www.flickr.com/photos/starmaid/5180282532/>.
Progressive International Mini Steamer (on line), Jul. 18, 2006. Retrieved from the Internet at the URL listed in the column immediately following this column: http://www.google.com/search?q=microwave+steamer&hl=en&biw=1291&bih=1015&se=X&ei=0ZuXTtqGMKbt0gGMyoHWBA&ved=0CAkQpwUoBg7source=int&tbs=cdr%3A1%2Ccd_min%3A%2Ccd_max%8A8%2F2%2F2007&tbm=#pq=microwave+steamer&hl=en&sugexp=gsih&cp=12&gs_id=9&xhr=1&q=microwave+mini+steamer&pf=p&sclient=psy-ab& biw=1291&bih=1015&tbs=img:1%2Ccdr%3A1%2Ccd..max%3A8%2F2%2P20068.
Mini Steamer—Progressive International / Starmaid vegetable steamer, [on line], retrieved Oct. 21, 2011. Retrieved from the Internet: URL:<http://www.campingcookwarepro.com/Progressive_International_Microwavable_Mini_Steamer>.
Tupperware India, Cook easy Microsteamer, The Hindu Business Line, [on line], Jun. 26, 2003, retrieved on Oct. 21, 2011, Retrieved from the Internet: URL:<http://www.thehindubusinessline.in/catalyst/2003/08/26/stories/2003062600070406.htm>.
Microwave mini steamer, Lunch in a Box, [on line]Feb. 12, 2007, retrieved on Oct. 13, 2011. Retrieved from the Internet: URL:<http://www.flickr.com/photos/24506652@N00/388209604/>.
Microwave steamer 2, Oct. 16, 2006, [on line]. Retrieved from the Internet: URL:<http://www.flickr.com/photos/momsinmind/271170248/>.
U.S. Official Action mailed May 2, 2012, in U.S. Appl. No. 11/903,732.
U.S. Official Action mailed May 2, 2012, in U.S. Appl. No. 12/040,641.
U.S. Official Action mailed Sep. 10, 2012, in U.S. Appl. No. 11/903,732.
U.S. Notice of Allowance and Fees Due in U.S. Appl. No. 29/424,416.
Succinylated Monoglycerides; http://www.fao.org/ag/agn/jecfa-additives/specs/Monograph1/Additive-443.pdf; 1982; obtained Sep. 14, 2012.
U.S. Official Action mailed Sep. 24, 2012, in U.S. Appl. No. 12/471,114.
U.S. Official Action mailed Sep. 25, 2012, in U.S. Appl. No. 12/040,641.
U.S. Official Action mailed Aug. 21, 2013, in U.S. Appl. No. 11/890,297.

(56) References Cited

OTHER PUBLICATIONS

U.S. Official Action mailed Sep. 19, 2013, in U.S. Appl. No. 12/471,114.
U.S. Official Action mailed Sep. 27, 2013, in U.S. Appl. No. 11/423,259.
U.S. Official Action mailed Oct. 3, 2013, in U.S. Appl. No. 11/703,066.
International Search Report mailed Dec. 4, 2013, in Application No. PCT/US2013/044064.
U.S. Official Action mailed Jan. 16, 2014, in U.S. Appl. No. 12/277,886.
U.S. Official Action Mailed Jan. 22, 2014, in U.S. Appl. No. 12/471,114.
U.S. Official Action Mailed Jan. 29, 2014, in U.S. Appl. No. 12/040,641.
International Search Report mailed Dec. 4, 2013 in Application No. PCT/US2013/044064.
U.S. Official Action Mailed Mar. 21, 2014, in U.S. Appl. No. 11/703,066.
U.S. Official Action Mailed Apr. 14, 2014, in U.S. Appl. No. 11/423,259.
U.S. Official Action Mailed Apr. 21, 2014, in U.S. Appl. No. 11/424,520.
U.S. Official Action Mailed Jun. 16, 2014, in U.S. Appl. No. 12/277,886.
U.S. Official Action Mailed Sep. 9, 2014, in U.S. Appl. No. 11/423,259.
U.S. Official Action Mailed Mar. 5, 2015, in U.S. Appl. No. 13/742,450.

* cited by examiner

FOOD TRAY

BACKGROUND OF THE INVENTION

Food trays for holding and heating a food product are well known. One type in common use has a single compartment. When a pasta or other low value product is heated for consumption in the single compartment, any sauce, which may contain meat and or vegetables, is layered on top or beside of the low value product. Heating of the food arranged in this manner causes the flavours to blend and textures to deteriorate. Another food tray has two compartments, one beside the other. Heating does not cause blending of flavour, but having to spoon sauce from one compartment to another for consumption by the customer is inconvenient.

In another food tray available in Europe from InterFrost GmbH, a smaller paperboard tray is nested snugly within a larger paperboard tray. The two trays fit tightly together. Sauce may be placed in the smaller tray, and pasta or rice in the larger tray. Upon heating of the InterFrost food tray, steam may build up in the lower tray, and may be released suddenly when the smaller tray is removed from the larger tray. In addition, due to the close tight fit of the smaller tray in the larger tray, the smaller tray tends to stick in the larger tray, and pulling on the smaller tray can result in a sudden release of the smaller tray, causing a risk of spilling hot food product from the smaller tray. The steam and heat generated from the lower tray may cause the upper tray to deconstruct, which increases the probability of spillage. Risk of steam release and hot food spill makes the food tray somewhat of a hazard to use.

SUMMARY OF THE INVENTION

The food tray of the present invention is intended to provide the advantages of separate heating of low and high value food products, while reducing the risk of spillage and steam release. In addition, the food tray of the present invention is convenient to use, and provides a pleasing aspect to the user.

Therefore, according to an aspect of the invention, there is provided a food tray, comprising a lower tray containing a first food product and an upper tray nested stably at least partly inside the lower tray, with the upper tray containing a second food product. An air permeable interface is provided between the upper tray and lower tray to allow venting of steam from the lower tray during cooking. A cover is provided for the upper food tray. Each of the lower tray and the upper tray are preferably formed of a material that is suitable for use in a microwave oven. Various constructions may be used to create the air permeable interface, such as lugs, ledges and lips. The upper tray may sit above the lower tray. The trays are preferably nested loosely for ease of removal of the upper tray from the lower tray. Various configurations of cover may be used such as a sleeve, carton, lid or plastic film. The upper tray may contain the higher value food product.

According to a further aspect of the invention, there is provided a method of cooking food products of different value, the method comprising the steps of providing a food tray comprising a first food product in a lower tray and a second food product in an upper tray nested loosely in the lower tray; and subjecting the food tray to food heating energy while permitting steam to escape from the lower tray.

These and other aspects of the invention are set out in the claims, which are incorporated here by reference.

BRIEF DESCRIPTION OF THE FIGURES

Preferred embodiments of the invention will now be described with reference to the figures, in which like reference characters denote like elements, by way of example, and in which.

DETAILED DESCRIPTION OF PREFERRED EMBODIMENTS

In the claims, the word "comprising" is used in its inclusive sense and does not exclude other elements being present. The indefinite article "a" before a claim feature does not exclude more than one of the feature being present.

Figure 1:
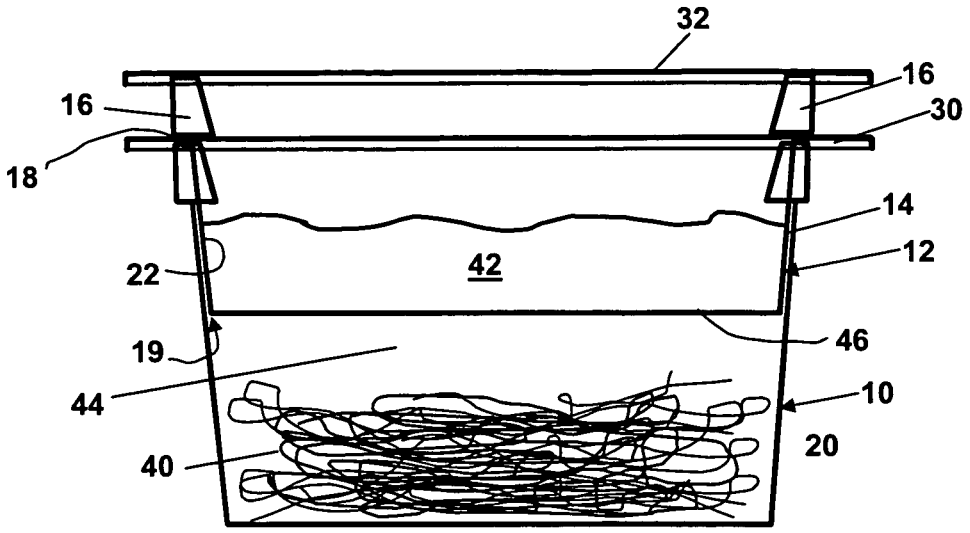
FIG. 1 is a section through a food tray comprising an upper tray and lower tray according to an embodiment of the invention.
Figure 2:
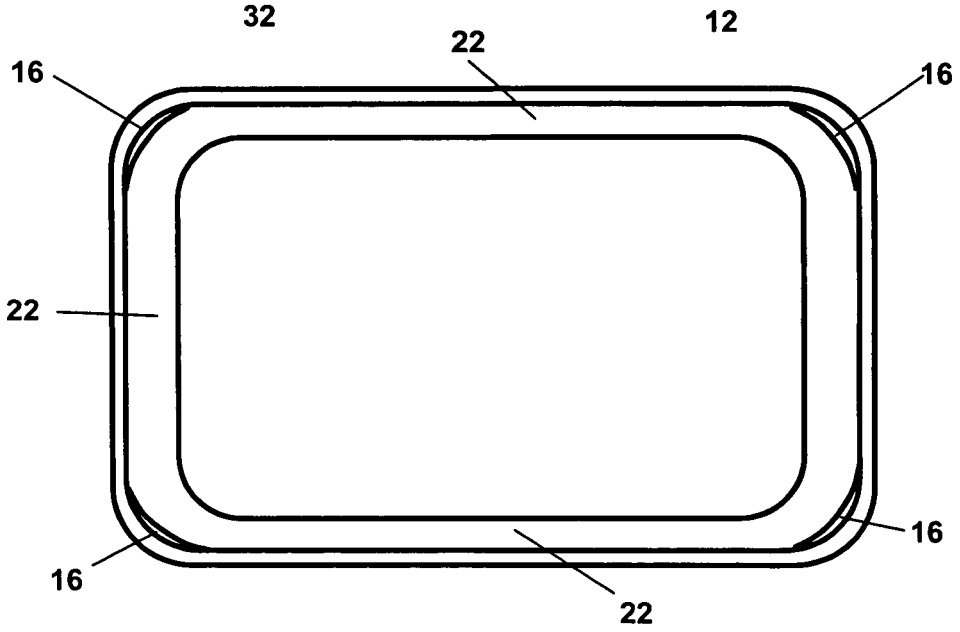
FIG. 2 is a top view of the food tray of FIG. 1.

As shown in FIGS. 1 and 2, a food tray is formed from a lower tray 10 and an upper tray 12 nested stably at least partly inside the lower tray 10. An air permeable interface 14 is provided between the upper tray 12 and lower tray 10 by outwardly extending lugs 16 at the corners of the upper tray 12. The lugs 16 rest on top of the upper edge 18 of the lower tray 10 with a gap 19 between the upper tray 12 and lower tray 10. The gap 19 may extend around the perimeter of the lower tray 12. With a gap between the lower tray 10 and upper tray 12, when product in the lower tray 10 is heated, any steam produced can vent through the gap 19.

The lugs 16 and gap 19 permit the upper tray 12 to sit loosely on the lower tray 10. The only force retarding removal of the upper tray 12 from the lower tray 10 is the force of gravity on the upper tray 12 and its contents. Removal of the upper tray 12 from the lower tray 10 is therefore frictionless. The lugs 16 are at the corners of the upper tray 12 as shown, but may be anywhere around the periphery of the upper tray 12. Four lugs are convenient, and there should be a sufficient number of lugs suitably spaced around the periphery of the upper tray 12 so that the upper tray is stable, and is resistant against tipping. To assist stability, the lugs 16 should be near the top of the upper tray 12 so that the main mass of the upper tray 12 and its contents are below the lugs 16.

Both the upper tray 12 and lower tray 10 include respective lips 32 and 30. The lips 32, 30 should be at least 3 mm wide for easy of sealing.

Each of the lower tray 10 and upper tray 12 may be made by injection moulding, thermoforming or any other suitable manufacturing process. The sidewalls 20 of the lower tray 10 and the sidewalls 22 of the upper tray 12 each may have the same nesting angle. The nesting angle of a tray is the angle between the sidewalls and a perpendicular to the plane defined by the upper edge of the tray. The upper tray 12 may be made in the same mould as the lower tray 10, but with an insert in the mould to reduce the volume. The upper tray 12 and the lower tray 10 should be formed of a material that is suitable for use in a microwave oven, and also may be formed of a material suitable for use in a conventional oven. Exemplary materials are paper, polypropylene (microwave only) and dual use CPET (crystalline polyethylene terephthalate) available from a number of manufacturers. CPET is particularly suitable due to its wide temperature tolerance. The trays 10, 12 may be transparent or opaque.

Figure 3:
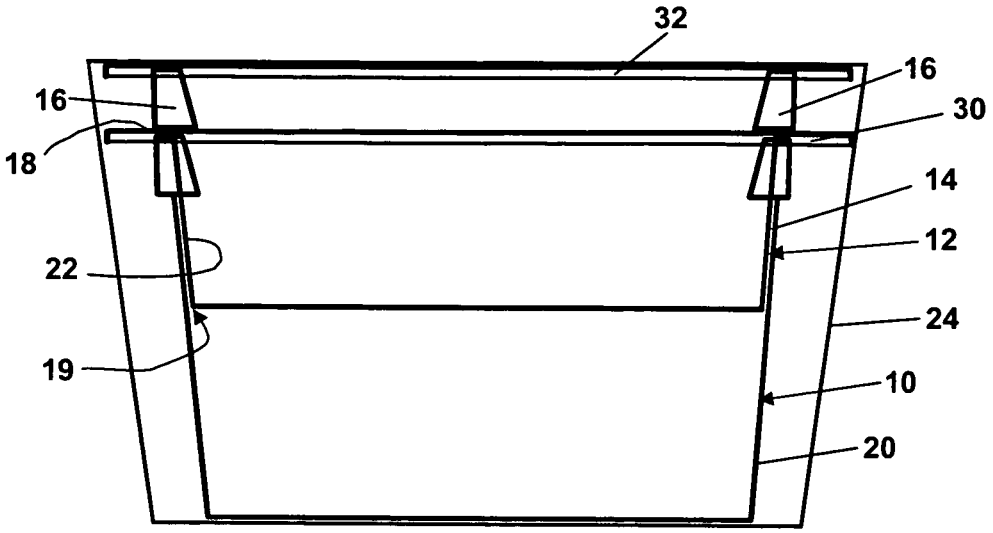
FIG. 3 shows the food tray of FIG. 1 with a cover.

As shown in FIG. 3, the food tray is preferably provided with a cover 24, such as a sleeve. The sleeve may be a paperboard sleeve into which the combined trays 10 and 12. are inserted. The cover 24 could also be a carton that encloses both trays 10 and 12 completely.

Figure 4:
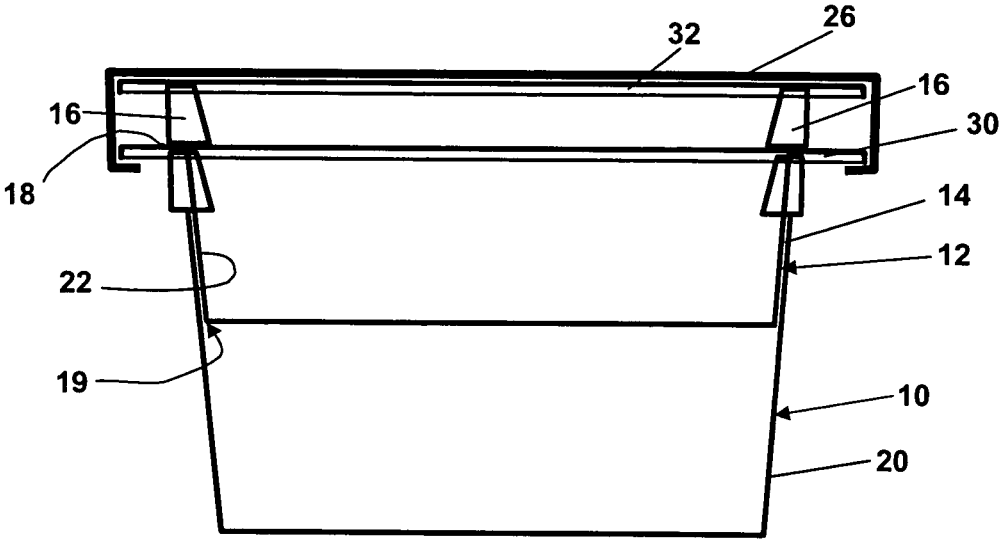
FIG. 4 shows an embodiment of the invention with a snap-on cover.
Figure 5:
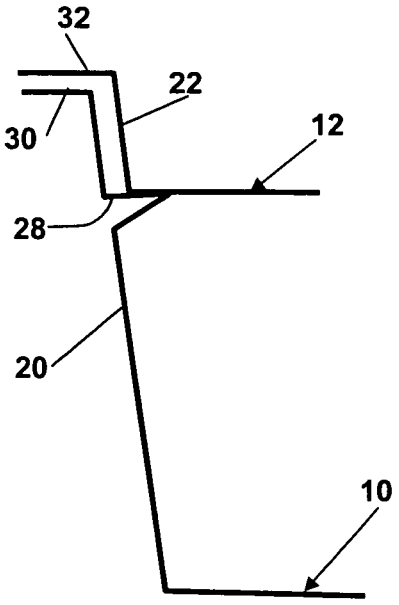
FIG. 5 is a section through a further embodiment of a food tray according to the invention.

As shown in FIG. 4, the cover may comprise a snap-on microwavable lid 26 for the upper tray 12. The lid 26 may extend over the lip 20 on the lower tray 10. The cover 24 may also include a film that is heat sealed to the lip 32 on the upper tray 12. The film may be on the underside of a cardboard sleeve, or a stand alone cover heat sealed to the lip 32.

Figure 6:
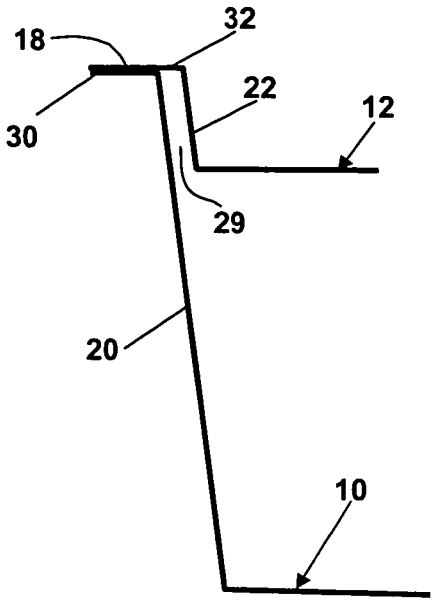
FIG. 6 is a section through a still further embodiment of a food tray according to the invention.
Figure 7:
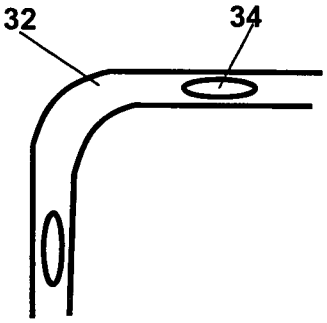
FIG. 7 is a top view of the upper food tray shown in FIG. 6.

As shown in FIG. 4, the air permeable interface may be formed by a seat created by lugs or ledges 28 formed in the sidewalls 20 of the lower tray 10 and spaced around the periphery of the lower tray 10, with the upper tray 12 resting directly on the lugs or ledges 28. Preferably, the lugs or ledges 28 are discontinuous or provided with openings to allow the escape of steam during cooking. As shown in FIG. 6, the air permeable interface may be formed by the lip 32 resting directly on the upper edge 18 of the lower tray 10. In this case, as shown in FIG. 7, the lip 32 is preferably provided with protrusions 34 for allowing steam release. In each of these cases, it is preferable that the air permeable interface supports the upper tray 12 in the lower tray 10 so that the lip 32 of the upper tray 12 sits above the lower tray 10. In the example of FIG. 7, the outwardly extending lip 32 of the upper tray 12 sits loosely on the upper edge 18 of the lower tray 10 to form the air permeable interface with a gap 29 between the side walls 22 of the upper tray 12 and the sidewalls 20 of the lower tray 10. The upper tray 12 and lower tray 10 may also have fluted sides to allow venting of steam during cooking. In another embodiment, the upper tray 12 may sit entirely within the lower tray 10 on lugs or ledges, with a handle provided on the upper tray 12 to allow the upper tray 12 to be easily removed from the lower tray 10.

Food is placed in each of the upper tray 12 and lower tray 10. The food product 42 in the upper tray 12 may be a higher value food product in terms of cost per weight than the food product 40 in the lower tray 10. Thus the lower tray 10 may include pasta, rice or vegetable, which is usually the higher volume product The upper tray 12 may include a sauce, such as cheese sauce, meat or seafood sauce, or vegetable sauce. Water may be added to the lower tray 10 to assist in cooking the food product in the lower tray 10. Preferably, a gap 44 is provided between the top of the food product 40 and the bottom 46 of the upper food tray 12 to avoid the food product 40 coming into contact with the bottom 46 of the upper food tray 12. In another embodiment, chili may be placed in the lower tray 10 and a biscuit in the upper tray 12. For food product such as a biscuit that should have a crisp exterior texture when cooked, a susceptor board may be placed in the tray with the food product.

When sold, the food tray, including food, may be wrapped in shrink wrap. For use, the customer removes the shrink wrap and deposits the food tray in an oven (conventional or microwave as appropriate for the materials), where the food tray is subject to food heating energy. If the upper tray 12 is sealed with a film, it may be removed or loosened prior to cooking depending on the cooking instructions. Due to the air permeable interface 14, the food tray permits steam to escape from the lower tray. Upon removal of the food tray from the oven, the higher value food product may be added to the lower value food product, simply by pouring the higher value food product into the lower tray. Due to the product being in separate trays, quicker more even heating is obtained. With the higher value product in the top tray, the aromas of the higher value product are easily available to the customer upon heating, and the higher value product also presents a pleasing aspect to the customer.

Either or both the cover 24 or the sidewalls 20, 22 may be provided with graphics illustrating the food product and providing instructions for use. In addition, there may be a stack of upper trays, all nested one above the other in like manner as upper tray 12 is nested in lower tray 10. The additional upper trays may conveniently have the same structure as the upper tray 12, and may contain different food products from those in upper tray 12, lower tray 10 or the other upper trays.

Immaterial modifications may be made to the embodiments of the invention described here without departing from the invention.

What is claimed is:

1. A food tray, comprising a lower tray containing a first food product, the lower tray having a base, a rim and sidewalls, the sidewalls extending vertically from the base to the rim, the sidewalls having a discontinuous ledge formed therein, the discontinuous ledge positioned entirely between the base and the rim of the lower tray and projecting inwardly to the lower tray;

an upper tray containing a second food product, the upper tray having a base, wherein the base of the upper tray rests on the discontinuous ledge so that the upper tray is nested at least partly inside the lower tray above the first food product and so that a gap is formed between sidewalls of the upper tray and sidewalls of the lower tray, wherein an air permeable interface is formed between the upper tray and the lower tray at points of discontinuity of the ledge;

a cover for at least one of the lower tray or the upper tray; and at least one of the lower tray or the upper tray being formed of a material that is at least partially microwave transparent for cooking of the first food product in the lower tray and the second food product in the upper tray, wherein the air permeable interface and the gap are configured to permit steam to escape from the lower tray during cooking of the first food product.

2. The food tray of claim 1 in which the cover comprises a cardboard sleeve that fits over both the upper tray and lower tray.

3. The food tray of claim 1 in which the cover comprises a snap-on microwavable lid for the upper tray.

4. The food tray of claim 1 in which the cover extends around a lip on the lower tray.

5. The food tray of claim 1 in which the upper tray and lower tray are each made of transparent material.

6. The food tray of claim 1 in which the upper tray is nested in the lower tray such that gravity retards removal of the upper tray from the lower tray.

7. The food tray of claim 1 in which the first food product is a lower value product than the second food product.

8. The food tray of claim 7 in which the first food product comprises pasta or rice.

9. The food tray of claim 1 in which the second food product comprises meat or seafood.

10. The food tray of claim 9 in which the second food product comprises a sauce.

11. The food tray of claim 1 in which the food tray is wrapped in shrink wrap.

12. A food tray, comprising a lower tray containing a first food product, the lower tray having a base, a rim and a sidewall, the sidewall extending vertically from the base to the rim to define a volume, the sidewall having a discontinuous ledge formed entirely between the base and rim, the discontinuous ledge projecting inwardly to the lower tray;

an upper tray having a base, wherein the base of the upper tray rests on the discontinuous ledge of the lower tray such that at least part of the upper tray is inside the lower tray above the first food product, the upper tray containing a second food product, wherein an air permeable interface between the lower tray and the upper tray is formed at points of discontinuity of the ledge to permit steam to escape from the lower tray during cooking of the first food product;

at least one of the lower tray or the upper tray being formed of a material that is at least partially microwave transparent for cooking of the first food product in the lower tray and the second food product in the upper tray; and a cover for at least one of the lower tray or the upper tray.

13. A food tray comprising:

a lower tray containing a first food product, the lower tray having a base, a lip forming a rim and a sidewall, the sidewall extending vertically from the base to the rim to define a volume, the sidewall having a discontinuous ledge formed entirely between the base and rim, the discontinuous ledge projecting inwardly to the lower tray;

an upper tray, the upper tray having a base, a lip forming a rim and a sidewall, the sidewall of the upper tray extending vertically from the base of the upper tray to the rim of the upper tray to define a volume, wherein the base of the upper tray rests on the discontinuous ledge of the lower tray such that at least part of the upper tray is inside the lower tray above the first food product, the upper tray containing a second food product, wherein an air permeable interface between the lower tray and the upper tray is formed at points of discontinuity of the ledge to permit steam to escape from the lower tray during cooking of the first food product;

at least one of the lower tray or the upper tray being formed of a material that is at least partially microwave transparent for cooking of the first food product in the lower tray and the second food product in the upper tray; and a cover for at least one of the lower tray or the upper tray, wherein the lip of the upper tray is spaced apart from and located above the lip of the lower tray to permit steam to pass between the lips.

14. The food tray of claim 1, wherein the discontinuous ledge is positioned between the base and the rim of the lower tray and projects inwardly beyond an intersection point between the sidewall of the lower tray and the base of the lower tray where the sidewall of the lower tray extends from the base of the lower tray to the rim of the lower tray.

* * * * *